US005557990A

United States Patent [19]

Shin

[11] Patent Number: 5,557,990

[45] Date of Patent: Sep. 24, 1996

[54] ACTUATING DEVICE FOR USE IN POWERED SCREWDRIVER

[76] Inventor: Fu-zong Shin, No. 6, Lane 84, Chinhua Rd., Taichung, Taiwan

[21] Appl. No.: 507,823

[22] Filed: Jul. 27, 1995

[51] Int. Cl.[6] ..... B25B 21/00

[52] U.S. Cl. ..... 81/54; 81/57.11; 81/429

[58] Field of Search ..... 81/54, 57, 57.11, 81/429, 52, 57.31, 436

[56] References Cited

U.S. PATENT DOCUMENTS

| | | | |
|---|---|---|---|
| 4,162,639 | 7/1979 | Gill | 81/429 |
| 4,617,843 | 10/1986 | Nishida et al. | 81/57.11 |

FOREIGN PATENT DOCUMENTS

| | | | |
|---|---|---|---|
| 3326993 | 2/1985 | Germany | 81/57.11 |
| 4307744 | 9/1993 | Germany | 81/54 |

*Primary Examiner*—D. S. Meislin
*Assistant Examiner*—Joni B. Danganan
*Attorney, Agent, or Firm*—Hedman, Gibson & Costigan, P.C.

[57] ABSTRACT

A powered screwdriver includes a tool head, a lower cylinder, a hollow shaft insertable through the lower cylinder, an upper cylinder engageable with the lower cylinder, a passage defined in the upper cylinder, a motor-driven axle insertable through the passage and engageable with the hollow shaft so that the hollow shaft and the motor-driven axle are slidable but not rotatable with respect to each other and an actuating device including a lower ring securely received in the passage, an actuator with a collar slidably mounted on the motor-driven axle and a tab radially extending from the collar and projecting through a slot defined in the upper cylinder, a spring mounted on the motor-driven axle, an upper ring securely received in the passage and a push-button switch mounted on the upper cylinder. When the powered screwdriver is pushed against a screw, the motor-driven axle is further inserted into the hollow shaft. The collar of the actuator is pushed by means of the hollow shaft. The push-button switch is pressed by means of the tab of the actuator.

2 Claims, 3 Drawing Sheets

ACTUATING DEVICE FOR USE IN POWERED SCREWDRIVER

BACKGROUND OF THE INVENTION

1. Field of the Invention

This invention relates to an actuating device for use in a powered screwdriver.

2. Related Prior Art

Automation is an inevitable trend in order to reduce cost related to labor in industry. Labor is replaced with machines in many assembly lines, however labor is irreplaceable under some circumstances, e.g., in a station for fabrication of a wide variety of products. In this case, a worker is often equipped with a powered tool. The worker can adapt himself or herself to various processes which are related to different products and the powered tool can increase efficiency of a repeated action.

Powered screwdrivers are often used in assembly lines for vehicles. A powered screwdriver includes a tool head attachable to a driving mechanism. A conventional driving mechanism includes a motor, a circuit which is connected with the motor, a gear train which is connected between the motor and the tool head and an actuating device. The actuating device consists of a bar which is pivotably linked to the powered screwdriver and a normally open push-button switch which is connected with the circuit. The bar is in engagement with the normally open push-button switch. The motor will be in operation when a worker grips the bar with one hand so as to press the normally open push-button switch. The operation of the motor stops when the worker releases the bar. The worker may feel pain in his or her said hand after many hours of gripping the bar. This invention is intended to solve the above-mentioned problem.

SUMMARY OF THE INVENTION

It is the primary objective of this invention to provide a powered screwdriver switch.

The primary objective of this invention is achieved by means of providing a powered screwdriver including a tool head, a lower cylinder, a hollow shaft insertable through the lower cylinder, an upper cylinder engageable with the lower cylinder, a passage defined in the upper cylinder, a motor-driven axle insertable through the passage and engageable with the hollow shaft so that the hollow shaft and the motor-driven axle are slidable but not rotatable with respect to each other and an actuating device including a lower ring securely received in the passage, an actuator with a collar slidably mounted on the motor-driven axle and a tab radially extending from the collar and projecting through a slot defined in the upper cylinder, a spring mounted on the motor-driven axle, an upper ring securely received in the passage and a push-button switch mounted on the upper cylinder. When the powered screwdriver is pushed against a screw, the motor-driven axle is further inserted into the hollow shaft. The collar of the actuator is pushed by means of the hollow shaft. The push-button switch is pressed by means of the tab of the actuator.

BRIEF DESCRIPTION OF THE DRAWINGS

The primary objective and other objectives of this invention will become obvious after a study of this invention described below with respect to the following drawings wherein.

DETAILED DESCRIPTION OF THE INVENTION

Figure 1:
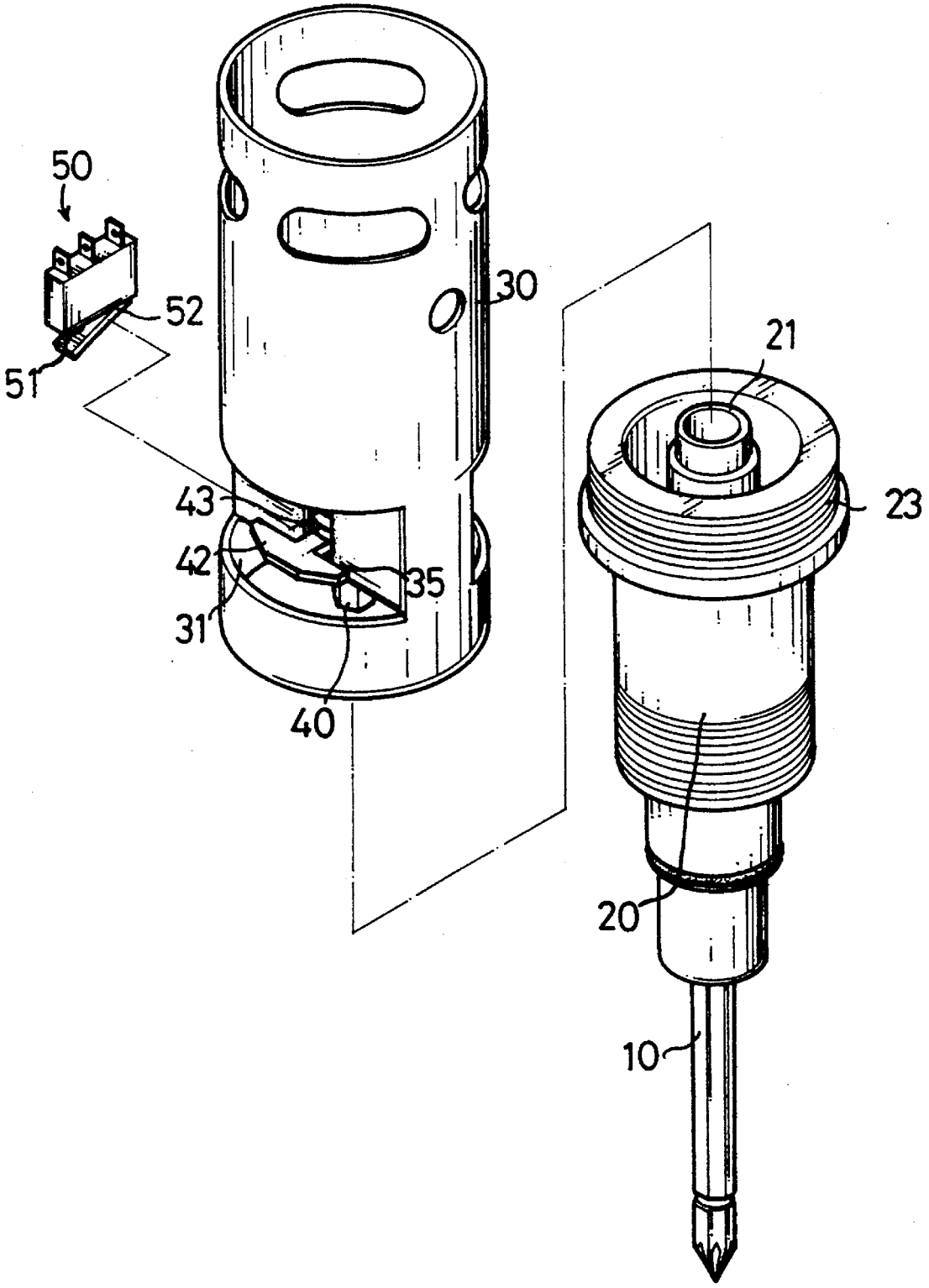
FIG. 1 is an exploded view of a portion of a powered screwdriver using the preferred embodiment of an actuating device according to this invention.
Figure 3:
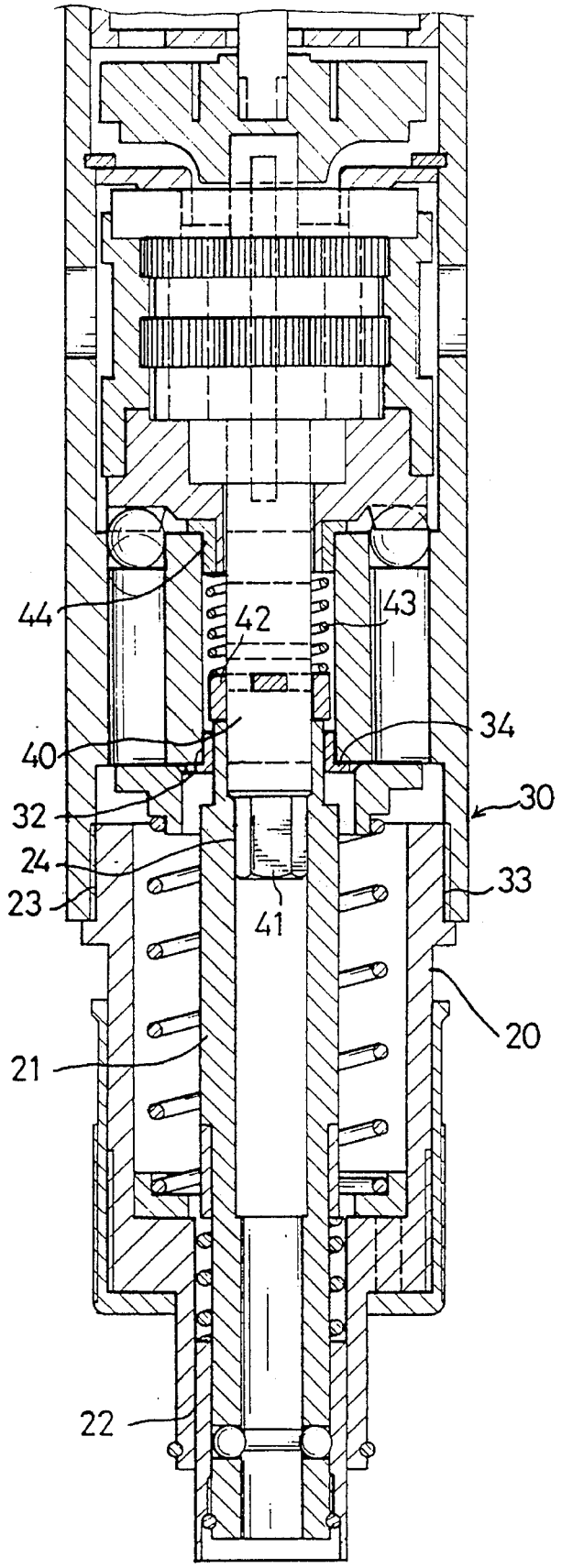
FIG. 3 is a cross-sectional view similar to FIG. 2 but showing the actuating device in a second position.

Referring to FIGS. 1 and 3, a powered screwdriver includes a tool head 10 with a tip for engagement with a screw (not shown) and an opposite tip for engagement with a hollow shaft 21 which is insertable through a hole 22 which is defined through a lower cylinder 20 which is engageable with an upper cylinder 30.

A thread 23 extends on an upper portion of an external surface of the lower cylinder 20. A thread 33 extends on a lower portion of an internal surface of the upper cylinder 30. The threads 23 and 33 are engageable with each other.

An internal surface of the hollow shaft 21 includes a non-circular portion 24 (seen in an axial direction), e.g., a hexagonal portion.

An axle 40 is insertable through a passage 32 defined in the upper cylinder 30. The axle 40 includes a lower end for engagement with the hollow shaft 21 and an upper end for engagement with a motor (not shown).

The lower end of the axle 40 is configured as a non-circular portion 41 (seen in an axial direction) corresponding to the non-circular portion 24, i.e., a hexagonal portion in the preferred embodiment.

The non-circular portions 24 and 41 are! engageable with each other. Thus, the hollow shaft 21 is rotatable with the axle 40. The hollow shaft 21 is slidable one the axle 40.

The upper end of the axle 40 is connected with a motor (not shown) by means of a gear train (not numbered). The axle 40, motor and gear and the interconnection between them will not be described in detail as they are Well known.

A ring 34 is securely received in a lower end of the passage 32 before the hollow shaft 21 is brought into engagement with the axle 40.

An actuator 42 consists of a collar and a tab radially projecting from the collar. The collar of the actuator 42 and a spring 43 are mounted on the axle 40 and received in the passage 32. The tab of the actuator 42 is insertable through a slot 35 which is longitudinally defined in a depressed portion of the upper cylinder 30. A ring 44 is securely received in an upper end of the passage 32. Thus, the collar of the actuator 42 and the spring 43 are restrained between the rings 34 and 44.

Figure 2:
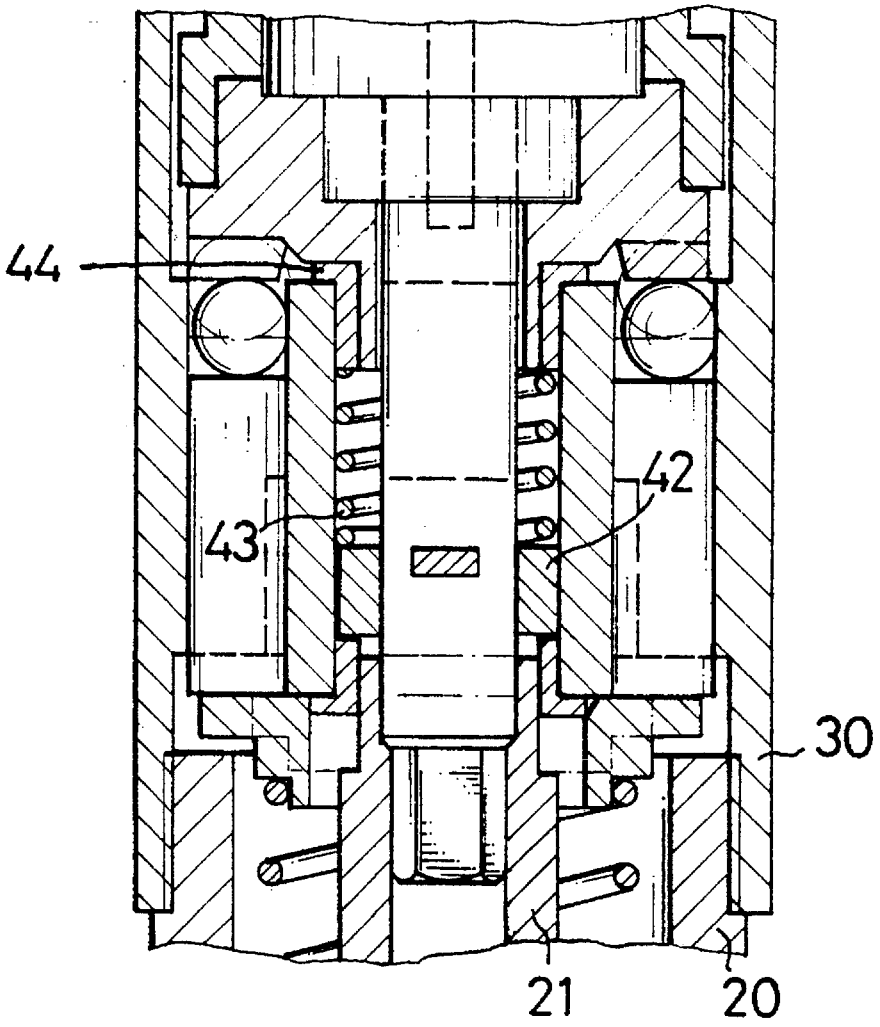
FIG. 2 is a cross-sectional view of the actuating device as shown in FIG. 1.

Referring to FIG. 2, the hollow shaft 21 is not in engagement with the collar of the actuator 42.

Referring to FIG. 1, a conventional microswitch 50 is received in the depressed portion of the upper cylinder 30. The microswitch 50 is connected with a circuit which is further connected with the motor. The circuit will not be described in detail as it is well known. The microswitch 50 includes a push button 51 and a lever 52. The lever 52 is in engagement with the tab of the actuator 42.

In operation, the powered screwdriver iS pushed against the screw. The actuator 42 is moved together with the upper cylinder 30 thus bringing the collar thereof into engagement with the hollow shaft 21. The push button 51 is pressed by means of the lever 52 which is the pivoted by means of the tab of the actuator 42. Thus, the motor is actuated.

I claim:

1. A powered screwdriver comprising a tool head (10), a lower cylinder (20), a hollow shaft (21) insertable through the lower cylinder (20), an upper cylinder (30) engageable with the lower cylinder (20), a passage (32) defined in the upper cylinder (30), a motor-driven axle (40) insertable through the passage (32) and engageable with the hollow shaft (21) so that the motor-driver axle and the hollow shaft are slidable but not rotatable with respect to each other and an actuating device including a lower ring (34) securely received in the passage (32), an actuator (42) with a collar slidably mounted on the motor-driven axle (40) and a tab radially extending from the collar and projecting through a slot (35) defined in the upper cylinder (30), a spring (43) mounted on the motor-driven axle (40), an upper ring (44) securely received in the passage (32) and-a push-button switch (50) mounted on the upper cylinder (30), wherein as the powered screwdriver is pushed against a screw, the motor-driven axle (40) is further inserted into the hollow shaft (21) so that the collar of the actuator (42) is pushed by means of the hollow shaft (21) so that the push-button switch (50) is pressed by means of the tab of the actuator (42).

2. A powered screwdriver according to claim 1 wherein the hollow shaft (21) includes an internal surface with a non-circular portion (24) and the motor-driven axle (40) includes a non-circular portion (41) in engagement with the non-circular portion (24).

* * * * *